US006405991B1

(12) United States Patent
Damiano

(10) Patent No.: US 6,405,991 B1
(45) Date of Patent: Jun. 18, 2002

(54) SUPPORT POLE

(75) Inventor: Armand A. Damiano, Omaha, NE (US)

(73) Assignee: Valmont Industries, Inc., Valley, NE (US)

( * ) Notice: Subject to any disclaimer, the term of this patent is extended or adjusted under 35 U.S.C. 154(b) by 0 days.

(21) Appl. No.: 09/664,160

(22) Filed: Sep. 18, 2000

(51) Int. Cl.[7] ..... F16M 13/00

(52) U.S. Cl. ..... 248/548; 248/900; 248/519; 52/99; 52/297; 52/736.1

(58) Field of Search ..... 248/548, 900, 248/519, 511, 530; 52/98, 99, 297, 298, 296, 153, 154, 736.1, 736.4

(56) References Cited

U.S. PATENT DOCUMENTS 565,618 A * 8/1896 Harman ..... 52/297
1,735,722 A * 11/1929 Beard ..... 52/168
3,645,057 A * 2/1972 Kaplan ..... 52/295
4,793,111 A * 12/1988 Shewchuk ..... 52/298
4,813,199 A * 3/1989 Lewis ..... 52/98
4,958,470 A * 9/1990 Han et al. ..... 52/296
5,481,846 A 1/1996 Macchietto ..... 52/720.1

* cited by examiner

*Primary Examiner*—Leslie A. Braun
*Assistant Examiner*—Gwendolyn Baxter
(74) *Attorney, Agent, or Firm*—Thomte, Mazour & Niebergall; Dennis L. Thomte

(57) ABSTRACT

A support pole including a baseplate attached to a footing and having a central opening formed therein. A hollow shaft has its lower end received by the central opening in the baseplate. The lower end of the shaft is shaped to provide one or more deformations which facilitate the shaft to baseplate connection.

50 Claims, 5 Drawing Sheets

SUPPORT POLE

BACKGROUND OF THE INVENTION

1. Field of the Invention

This invention relates to a support pole and more particularly to a means for providing a mechanical connection of the shaft of the support pole to a baseplate with that connection providing a unique breakaway solution.

2. Description of the Related Art

Support poles for supporting lights, etc., thereon are commonly constructed of a composite material or a metal material such as aluminum or steel. In most instances, the support pole comprises a pole member or shaft which is secured to a flat baseplate which in turn is secured to a concrete footing. When the shaft is comprised of aluminum or steel, the shaft is normally welded to the metal baseplate. If the shaft is constructed of aluminum, the welding operation may weaken the shaft in the area of the weldment. Further, the welding operation adds to the overall cost of the support pole. When the shaft is comprised of a composite material, such as graphite fibers, carbon fibers, etc., it is usually necessary to form the baseplate with the shaft, which increases the cost of manufacturing or fabricating the same. Further, in all instances, whether the shaft is comprised of metal or composite materials, the breakaway characteristics of the shaft with respect to the baseplate must be considered.

SUMMARY OF THE INVENTION

A support pole is described which includes a horizontally disposed baseplate for attachment to a footing with the baseplate having an upper surface and a lower surface. The baseplate has an opening formed therein which extends between the upper surface and the lower surface and which is adapted to have the lower end of the hollow pole member or shaft received therein. The shaft is shaped at its lower end to create a deformation to provide a mechanical connection of the shaft to the baseplate. In one form of the invention, the deformation enlarges the diameter of the shaft. In another embodiment, the deformation may reduce the diameter of the shaft. In yet another embodiment, two deformations are created in the shaft, one above and one below the baseplate. In yet another embodiment of the invention, a single deformation is created in the shaft, with the deformation being located within the baseplate. The deformation(s) may extend completely around the shaft perimeter or in a selected area or areas. The deformation profile affects the load capacity, fatigue and breakaway performance of the support pole. The baseplate profile also affects the load capacity, fatigue and breakaway performance of the support pole. The opening in the baseplate which receives the shaft may be shaped to provide torsional resistance and may have material added for fatigue or abrasion issues. The baseplate to shaft connection described herein eliminates welding, post heat treatment and enables the weight of the support pole to be reduced.

It is therefore a principal object of the invention to provide an improved support pole.

Still another object of the invention is to provide a mechanical connection for the shaft of the pole to a baseplate.

Still another object of the invention is to provide a baseplate to shaft connection which provides a unique breakaway solution.

Still another object of the invention is to provide a support pole having a deformation provided on the shaft thereof for accommodating a baseplate.

Still another object of the invention is to provide a support pole wherein a deformation enlarges the diameter of the shaft.

Still another object of the invention is to provide a support pole wherein a deformation reduces the diameter of the shaft.

Still another object of the invention is to provide a support pole having a pair of spaced-apart deformations formed in the shaft thereof with one of the deformations being positioned above the baseplate and the other deformation being positioned below the baseplate.

Still another object of the invention is to provide a support pole having a deformation formed in the shaft thereof which is located within the baseplate.

Still another object of the invention is to provide a support pole having a deformation formed in the lower end of the shaft thereof which may extend continuously around the shaft perimeter or which may be provided in selected areas of the shaft perimeter.

Still another object of the invention is to provide a baseplate to shaft connection for a pole member wherein the baseplate opening is shaped to provide torsional resistance.

Still another object of the invention is to provide a baseplate to shaft connection for a support pole wherein the baseplate opening has material added therein for fatigue or abrasion issues.

Still another object of the invention is to provide a baseplate to shaft connection for a support pole wherein the baseplate opening has material added therein for strengthening purposes.

Still another object of the invention is to provide a baseplate to shaft connection for a support pole which may be comprised of metal or composite material.

Yet another object of the invention is to provide a baseplate to shaft connection for a support pole wherein the need for welding the support pole to a baseplate is eliminated.

Still another object of the invention is to provide a baseplate to shaft connection for a support pole which eliminates the need for post heat treatment.

Yet another object of the invention is to provide a baseplate to shaft connection for support pole which results in a weight reduction of the support pole and baseplate.

These and other objects will be apparent to those skilled in the art.

DESCRIPTION OF THE PREFERRED EMBODIMENT

Figure 2:
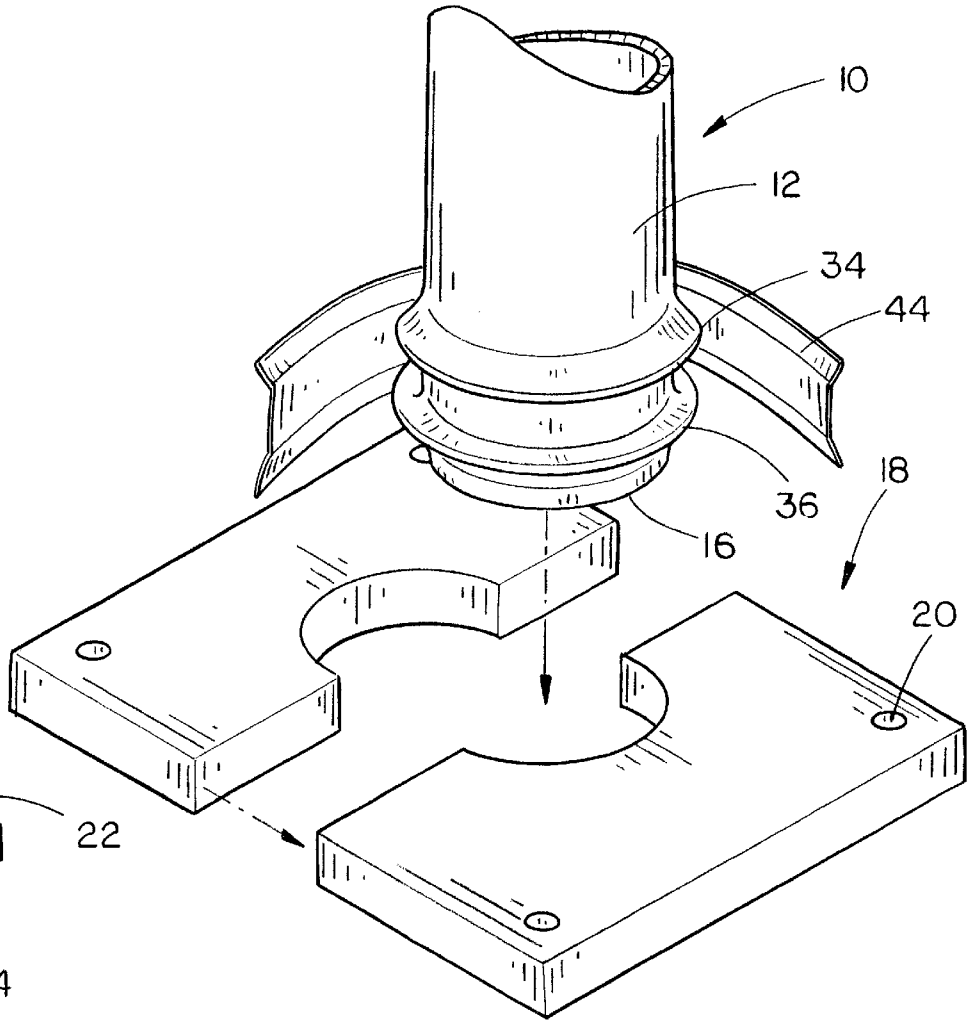
FIG. 2 is a partial exploded perspective view of the embodiment of FIG. 1 and further including a boot-like member positioned between the shaft of the support pole and the base plate.

The support pole of this invention is referred to generally by the reference numeral 10. Pole 10 includes a hollow shaft 12 having an upper end 14 (not shown) and a lower end 16. Pole 10 may be comprised of steel, aluminum,. or a composite material such as graphite fibers, carbon fibers, combinations thereof, etc. Pole 10 includes a base plate 18 which may be of single piece or multiple piece construction. Normally, base plate 18 is constructed of iron, steel, aluminum, or other suitable material. Base plate 18 is provided with bolt openings 20 which are adapted to receive anchor bolts 22 extending upwardly therethrough which are embedded in a concrete footing. Normally, adjustment nuts are mounted on the bolts 22 below base plate 18 to enable the base plate 18 (and pole 10) to be plumbed. Usually, base plate 18 is spaced above the upper surface of the footing. Base plate 18 is provided with a central opening 32.

Figure 1:
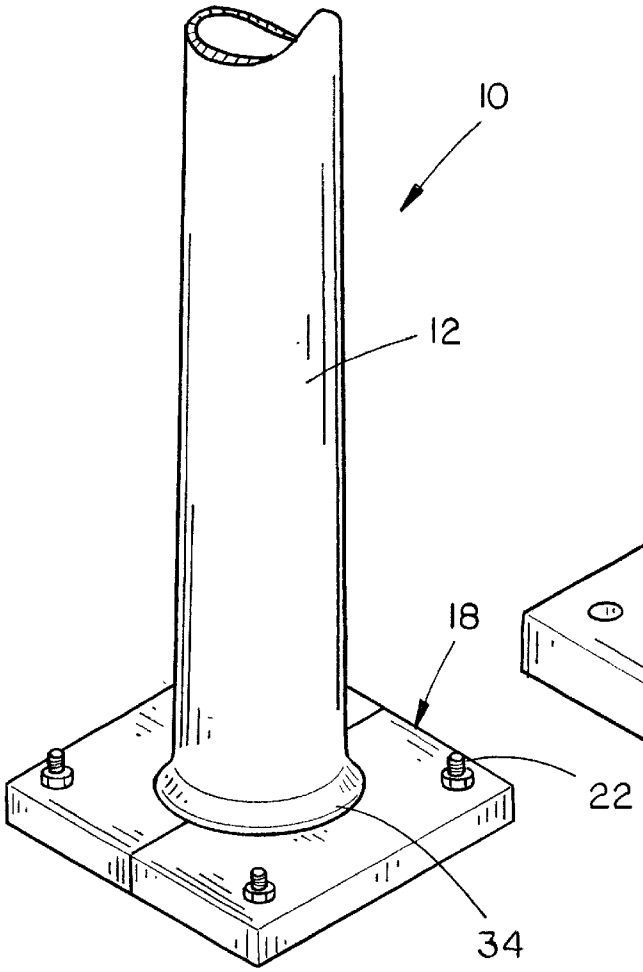
FIG. 1 is a partial perspective view of one embodiment of the support pole.
Figure 3:
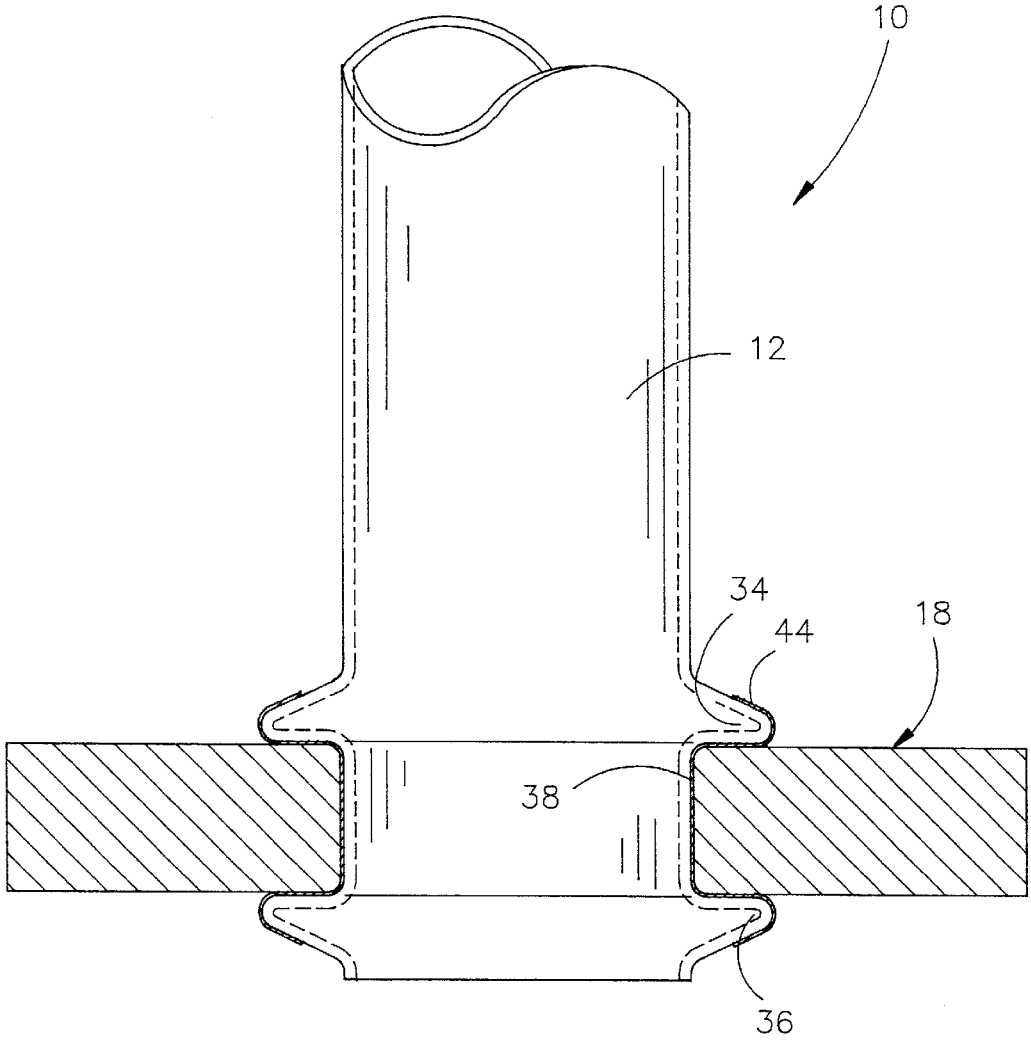
FIG. 3 is a partial vertical sectional view of the embodiment of FIGS. 1 and 2.

The primary purposes of this invention are to provide a means for mechanically securing the baseplate 18 to the shaft 12 and to provide a unique breakaway solution. The purposes are achieved by shaping the lower end of the shaft (tube) 12 to create a deformation with the deformation taking several forms. In the embodiment of FIGS. 1–3, a pair of deformations 34 and 36 are created by enlarging the diameter of the shaft 12 with deformation 34 being positioned above base plate 18 and deformation 36 being positioned below base plate 18. For purposes of discussion, the exterior portion of the shaft 12 between deformations 34 and 36 will be identified by the reference numeral 38. The diameter of opening 32 of base plate 18 may be considerably greater than the exterior portion 38 to define a space 40 therebetween. In those cases where space 40 is provided, it is preferred that a compressible material 42 will be positioned in space 40 to facilitate breakaway.

Figure 4:
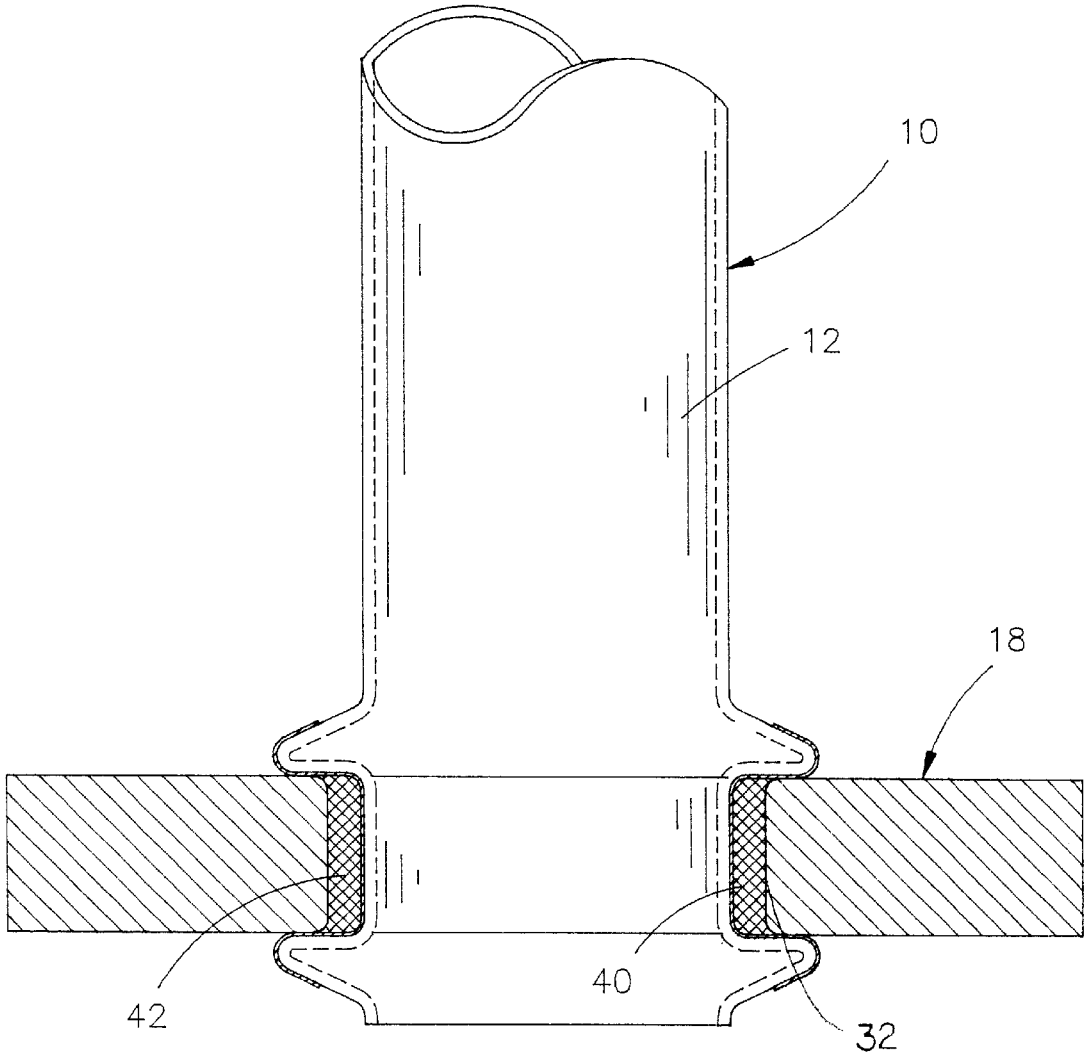
FIG. 4 a partial sectional view of a further embodiment of the pole of FIGS. 1–3 wherein a compressible material is positioned between the base plate and the shaft.

In FIG. 4, a shaft-baseplate connection is illustrated wherein the diameter of exterior portion 38 is just slightly smaller than the diameter of opening 32 in base plate 12. In the embodiment of FIG. 4, it is preferred that an anti-abrasion member such as a boot-like membrane 44 comprised of graphite fiber, carbon fiber, or combinations thereof, be positioned between the shaft 12 and the baseplate 18 to prevent the baseplate 18 from sawing through the shaft 12 as shaft 12 is moved by the wind relative to baseplate 18. This is especially important where the shaft 12 is comprised of an aluminum material and baseplate 18 is comprised of a steel material.

Figure 6:
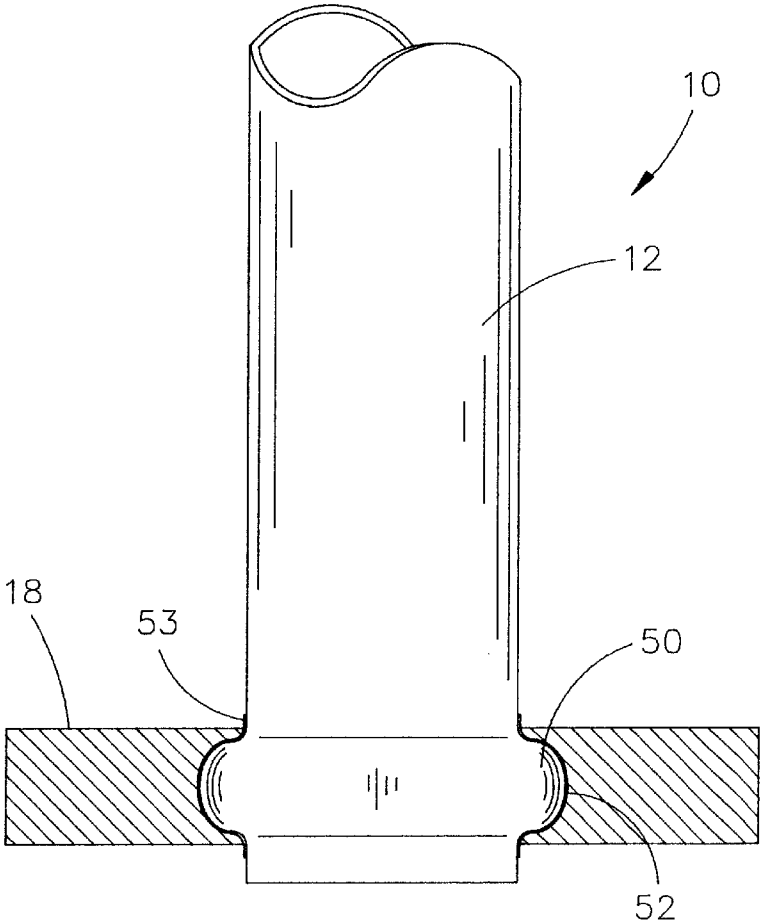
FIG. 6 is a partial vertical sectional view illustrating a further embodiment of the invention wherein shaft diameter is increased.
Figure 5:
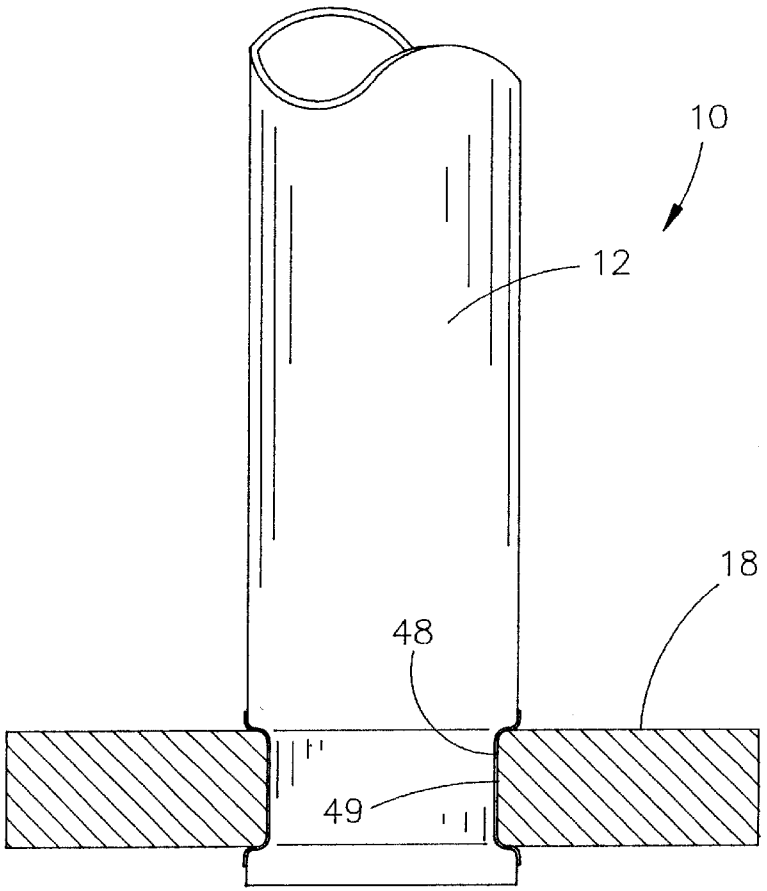
FIG. 5 is a partial sectional view of a further embodiment of the invention wherein the shaft diameter is reduced.
Figure 7:
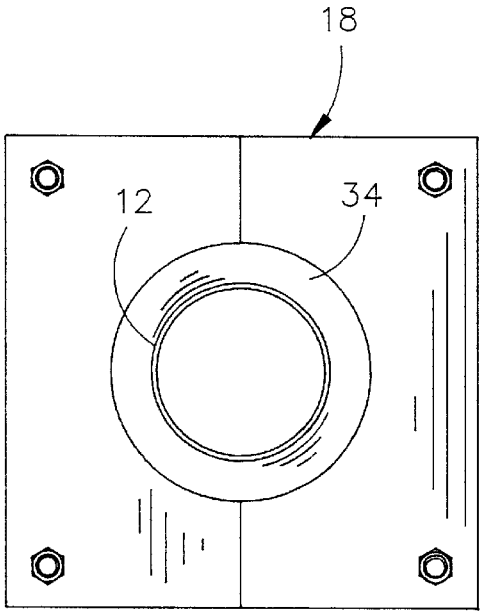
FIG. 7 is a top view of the embodiment of FIGS. 1–3.

FIG. 5 illustrates another embodiment of the invention wherein the diameter of the shaft 12 is decreased to create the deformation 48 which receives the baseplate 18. Preferably, an anti-abrasion membrane 49 is positioned between shaft 12 and baseplate 18, as seen in FIG. 5. FIG. 6 illustrates yet another embodiment of the invention wherein the diameter of the shaft is increased to form a single deformation 50 which is received by a recessed area 52 formed in baseplate 18 between the upper and lower surfaces thereof. Preferably, an anti-abrasion membrane 53 is positioned between shaft 12 and baseplate 18, as seen in FIG. 6.

When the shaft 12 is comprised of a composite material, it is preferred that a reinforcing or strengthening boot such as the boot-like membrane 44 be positioned between the shaft 12 and the baseplate 18. In some cases, the boot 54 will be formed from the same material as the shaft 12 and will be secured to the shaft 12 and the deformation for deformations by epoxy or the like.

Figure 8:
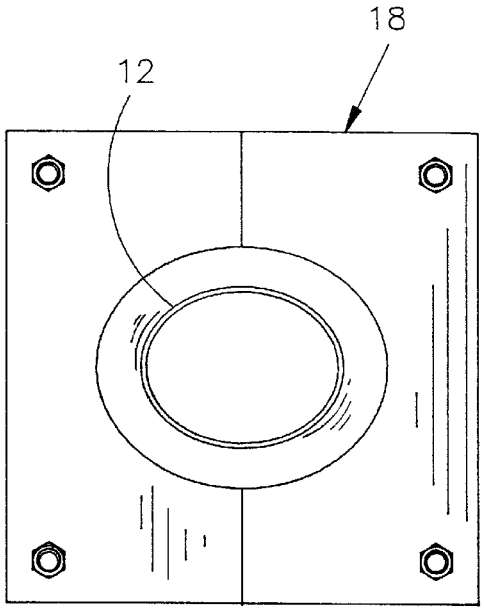
FIGS. 8–10 illustrate oval, square and hexagonal pole cross sections.
Figure 9:
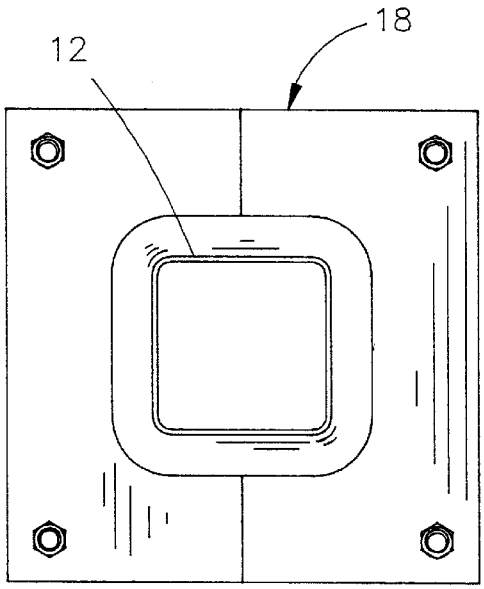
Figure 10:
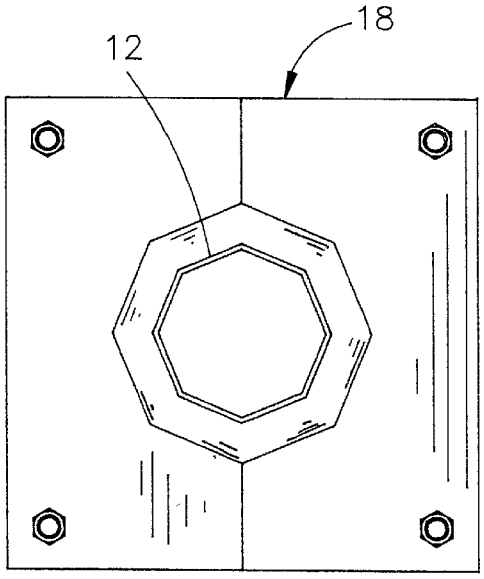

The deformations described above may extend completely around (360°) the diameter of the shaft 12 or may be provided in a selected area or selected areas as desired. The baseplate opening 32 may be shaped to provide torsional resistance to prevent rotation of shaft 12 with respect to base plate 18. In other words, opening 32 may not necessarily be circular, but could be oval, have protrusions thereon, etc., which interact with the shape of shaft 12 to prevent rotation of shaft 12 with respect to baseplate 18, such as seen in FIGS. 8–10.

The baseplate 18 may be constructed of a single piece or multiple pieces. If the baseplate 18 is formed as a single piece, the baseplate 18 will be positioned on the shaft 12 as the deformation or deformations are formed in the shaft 12.

The deformation profile will affect the load capacity, fatigue and breakaway performance of the pole. The fact that the shaft 12 is secured to the baseplate 18 by a deformation or deformations eliminates the need for welding the shaft 12 to the baseplate 18, thereby reducing the cost of manufacturing the pole, but also eliminating the possible weakening of aluminum shafts in the weldment areas. Further, the elimination of the welding process eliminates the need for post heat treatment. Additionally, the invention herein permits steel baseplates to be used.

Thus it can be seen that the invention accomplishes at least all of its stated objectives.

I claim:

1. A support pole, comprising:

a horizontally disposed baseplate for attachment to a footing;

said baseplate having an upper surface and a lower surface;

said baseplate having an opening formed therein which extends between said upper surface and said lower surface;

a hollow shaft having upper and lower ends;

said lower end of said shaft being received by said opening in said baseplate;

said hollow shaft having an outwardly extending first deformation positioned between said upper and lower ends thereof;

said first deformation having a lower surface which engages said upper surface of said baseplate.

2. The support pole of claim 1 wherein said lower end of said shaft is positioned below said lower surface of said baseplate.

3. The support pole of claim 2 wherein said shaft is shaped so that said shaft has an outwardly extending second deformation positioned below said lower surface of said baseplate which is in engagement therewith.

4. The support pole of claim 3 wherein said second deformation comprises a protrusion which extends completely around said shaft.

5. The support pole of claim 3 wherein said second deformation comprises at least a pair of radially spaced-apart protrusions.

6. The support pole of claim 3 wherein said shaft is comprised of an aluminum material.

7. The support pole of claim 1 wherein said first deformation comprises a protrusion which extends completely around said shaft.

8. The support pole of claim 1 wherein said first deformation comprises at least a pair of radially spaced-apart protrusions.

9. The support pole of claim 1 wherein said opening in said baseplate is larger than the diameter of the portion of the shaft which is positioned therein to define a clearance space therebetween; said clearance space being filled with a compressible material.

10. The support pole of claim 1 wherein said opening in said baseplate is larger than the diameter of the portion of the shaft which is positioned therein to define a clearance space therebetween; and an anti-abrasion material positioned in said clearance space.

11. The support pole of claim 9 wherein said anti-abrasion material is boot-shaped.

12. The support pole of claim 9 wherein said shaft is comprised of a composite material and wherein said anti-abrasion material comprises a sheet member adhered to said first deformation and the exterior of said shaft.

13. The support pole of claim 12 wherein said shaft is shaped so that said shaft has an outwardly extending second deformation positioned below said lower surface of said baseplate which is in engagement therewith and wherein said sheet member is also adhered to said second deformation.

14. The support pole of claim 1 wherein said opening in said baseplate is larger than the diameter of the portion of the shaft which is positioned therein to define a clearance space therebetween; and an anti-fatigue material positioned in said clearance space.

15. The support pole of claim 1 wherein said opening in said baseplate is shaped to provide resistance to torsional movement of said shaft.

16. The support pole of claim 1 wherein said shaft is comprised of an aluminum material.

17. A support pole, comprising:

a horizontally disposed baseplate for attachment to a footing;

said baseplate having an upper surface and a lower surface;

said baseplate having an opening formed therein which extends between said upper surface and said lower surface;

a hollow shaft having upper and lower ends;

said lower end of said shaft being received by said opening in said baseplate, said shaft being shaped to create an outwardly extending deformation formed therein which is positioned between said upper and lower surfaces of said baseplate; said baseplate having a recessed portion formed therein which extends inwardly into said baseplate from said opening therein; said recessed portion of said baseplate receiving said outwardly extending deformation therein.

18. The support pole of claim 17 wherein said lower end of said shaft is positioned below said lower surface of said baseplate.

19. The support pole of claim 17 wherein said deformation comprises a protrusion which extends completely around said shaft.

20. The support pole of claim 17 wherein said deformation comprises at least a pair of radially spaced-apart protrusions.

21. The support pole of claim 17 wherein said opening in said baseplate is larger than the diameter of the portion of the shaft which is positioned therein to define a clearance space therebetween; said clearance space being filled with a compressible material.

22. The support pole of claim 17 wherein said opening in said baseplate is larger than the diameter of the portion of the shaft which is positioned therein to define a clearance space therebetween; and an anti-abrasion material positioned in said clearance space.

23. The support pole of claim 22 wherein said anti-abrasion material is boot-shaped.

24. The support pole of claim 22 wherein said shaft is comprised of a composite material and wherein said anti-abrasion material comprises a sheet member adhered to said deformation and the exterior of said pole.

25. The support pole of claim 17 wherein said opening in said baseplate is larger than the diameter of the portion of the shaft which is positioned therein to define a clearance space therebetween; and an anti-fatigue material positioned in said clearance space.

26. The support pole of claim 17 wherein said baseplate is comprised of at least two baseplate portions.

27. The support pole of claim 17 wherein said opening in said baseplate is shaped to provide resistance to torsional movement of said shaft.

28. The support pole of claim 17 wherein said shaft is comprised of an aluminum material.

29. A support pole, comprising:

a horizontally disposed baseplate for attachment to a footing;

said baseplate having an upper surface and a lower surface;

said baseplate having an opening formed therein which extends between said upper surface and said lower surface;

a hollow shaft having upper and lower ends;

said lower end of said shaft being received by said opening in said baseplate;

said shaft being shaped to create an inwardly extending deformation formed in the exterior surface thereof which receives the baseplate therein.

30. The support pole of claim 29 wherein said lower end of said shaft is positioned below said lower surface of said baseplate.

31. The support pole of claim 29 wherein said deformation extends completely around said shaft.

32. The support pole of claim 29 wherein said opening in said baseplate is shaped to provide resistance to torsional movement of said shaft.

33. The support pole of claim 29 wherein said shaft is comprised of an aluminum material.

34. A support pole, comprising:

a horizontally disposed baseplate for attachment to a footing;

said baseplate having an upper surface and a lower surface;

said baseplate having an opening formed therein which extends between said upper surface and said lower surface;

a hollow shaft having upper and lower ends;

said lower end of said shaft being received by said opening in said baseplate;

said shaft being shaped to create an outwardly extending first and second deformation;

said first deformation being positioned above said upper surface of said baseplate which is in engagement therewith;

said second deformation being positioned below said lower surface of said baseplate which is in engagement therewith;

said second deformation comprising a protrusion which extends completely around said shaft.

35. A support pole, comprising:

a horizontally disposed baseplate for attachment to a footing;

said baseplate having an upper surface and a lower surface;

said baseplate having an opening formed therein which extends between said upper surface and said lower surface;

a hollow shaft having upper and lower ends;

said lower end of said shaft being received by said opening in said baseplate;

said shaft being shaped to create an outwardly extending first and second deformation;

said first deformation being positioned above said upper surface of said baseplate which is in engagement therewith;

said second deformation being positioned below said lower surface of said baseplate which is in engagement therewith;

said second deformation comprising at least a pair of radially spaced-apart protrusions.

36. A support pole, comprising:

a horizontally disposed baseplate for attachment to a footing;

said baseplate having an upper surface and a lower surface;

said baseplate having an opening formed therein which extends between said upper surface and said lower surface;

a hollow shaft having upper and lower ends;

said lower end of said shaft being received by said opening in said baseplate;

said shaft being shaped to create an outwardly extending first deformation positioned above said upper surface of said baseplate which is in engagement therewith;

said first deformation comprising at least a pair of radially spaced-apart protrusions.

37. A support pole, comprising:

a horizontally disposed baseplate for attachment to a footing;

said baseplate having an upper surface and a lower surface;

said baseplate having an opening formed therein which extends between said upper surface and said lower surface;

said opening in said baseplate being larger than the diameter of the portion of the shaft which is positioned therein to define a clearance space therebetween; said clearance space being filled with a compressible material;

a hollow shaft having upper and lower ends;

said lower end of said shaft being received by said opening in said baseplate;

said shaft being shaped to create an outwardly extending first deformation positioned above said upper surface of said baseplate which is in engagement therewith.

38. A support pole, comprising:

a horizontally disposed baseplate for attachment to a footing;

said baseplate having an upper surface and a lower surface;

said baseplate having an opening formed therein which extends between said upper surface and said lower surface;

said opening in said baseplate being larger than the diameter of the portion of the shaft which is positioned therein to define a clearance space therebetween; and an anti-abrasion material positioned in said clearance space;

a hollow shaft having upper and lower ends;

said lower end of said shaft being received by said opening in said baseplate;

said shaft being shaped to create an outwardly extending first deformation positioned above said upper surface of said baseplate which is in engagement therewith.

39. The support pole of claim 38 wherein said anti-abrasion material is boot-shaped.

40. The support pole of claim 38 wherein said shaft is comprised of a composite material and wherein said anti-abrasion material comprises a sheet member adhered to said first deformation and the exterior of said shaft.

41. The support pole of claim 40 wherein said shaft is shaped so that said shaft has an outwardly extending second deformation positioned below said lower surface of said baseplate which is in engagement therewith and wherein said sheet member is also adhered to said second deformation.

42. A support pole, comprising:

a horizontally disposed baseplate for attachment to a footing;

said baseplate having an upper surface and a lower surface;

said baseplate having an opening formed therein which extends between said upper surface and said lower surface;

said opening in said baseplate being larger than the diameter of the portion of the shaft which is positioned therein to define a clearance space therebetween; and an anti-fatigue material positioned in said clearance space;

a hollow shaft having upper and lower ends;

said lower end of said shaft being received by said opening in said baseplate;

said shaft being shaped to create an outwardly extending first deformation positioned above said upper surface of said baseplate which is in engagement therewith.

43. A support pole, comprising:

a horizontally disposed baseplate for attachment to a footing;

said baseplate having an upper surface and a lower surface;

said baseplate having an opening formed therein which extends between said upper surface and said lower surface;

a hollow shaft having upper and lower ends;

said lower end of said shaft being received by said opening in said baseplate;

said shaft being shaped to create an inwardly extending deformation formed in the exterior surface thereof which receives the baseplate therein; the diameter of said inwardly extending deformation is less than the diameter of said opening in said baseplate to define a clearance space therebetween.

44. The support pole of claim 43 wherein said clearance space is filled with a compressible material.

45. The support pole of claim 43 wherein an anti-abrasion material is positioned in said clearance space.

46. The support pole of claim 45 wherein said anti-abrasion material is boot-shaped.

47. The support pole of claim 46 wherein said shaft is comprised of a composite material and wherein said anti-abrasion material comprises a sheet member adhered to said first deformation and the exterior of said shaft.

48. The support pole of claim 43 wherein an anti-fatigue material is positioned in said clearance space.

49. The support pole of claim 43 wherein a strengthening material is positioned in said clearance space.

50. The support pole of claim 49 wherein said shaft is comprised of a composite material and wherein said strengthening material comprises a sheet member adhered to said first deformation and the exterior of said shaft.

* * * * *